United States Patent [19]

Vidal-Meza

[11] 4,352,393

[45] Oct. 5, 1982

[54] HEAT EXCHANGER HAVING A CORRUGATED SHEET WITH STAGGERED TRANSITION ZONES

[75] Inventor: Gonzalo D. Vidal-Meza, Peoria, Ill.

[73] Assignee: Caterpillar Tractor Co., Peoria, Ill.

[21] Appl. No.: 183,513

[22] Filed: Sep. 2, 1980

[51] Int. Cl.[3] ..... F28C 1/00

[52] U.S. Cl. ..... 165/166; 29/157.3 D; 29/157.3 R

[58] Field of Search ..... 165/166, 165, 167, 110; 113/118 R; 29/157.3 D, 157.3 R

[56] References Cited

U.S. PATENT DOCUMENTS

| | | | |
|---|---|---|---|
| 2,596,642 | 5/1952 | Boesad | 165/166 |
| 3,759,323 | 9/1973 | Dawson et al. | 165/166 |
| 3,887,664 | 6/1975 | Regehr | 165/166 |
| 4,180,129 | 12/1979 | Sumitomo | 165/110 |
| 4,241,599 | 12/1980 | Kaupert | 72/379 |
| 4,314,605 | 2/1982 | Sumitomo et al. | 165/110 |

FOREIGN PATENT DOCUMENTS

| | | | |
|---|---|---|---|
| 1197933 | 7/1970 | United Kingdom | 165/166 |

*Primary Examiner*—Albert W. Davis, Jr.
*Assistant Examiner*—J. Huang
*Attorney, Agent, or Firm*—Anthony N. Woloch

[57] ABSTRACT

A heat exchanger (24) includes a plurality of heat exchanging sheets (1) arranged in a stack (12), with each sheet having a central corrugated portion (14), flattened edge portions (16,18), and a transition zone (28) intermediate the corrugated portion and the edge portions of each of the plurality of the generally longitudinally extending convolutions (26) in the corrugated portions. Advantageously, the transition zones (28) are located at different longitudinal positions transversely across the individual sheets in order to stagger certain bulges (30) thereat, which bulges are formed during crushing of the edge portions and which would otherwise cause fluid flow blockage of the cross sectional passage regions between the sheets.

5 Claims, 4 Drawing Figures

HEAT EXCHANGER HAVING A CORRUGATED SHEET WITH STAGGERED TRANSITION ZONES

DESCRIPTION

1. Technical Field

The present invention relates generally to heat exchangers, and more particularly to a heat exchanger having a plurality of sheets so constructed as to control the availability of adequately opened flow paths for the efficient passage of heat exchanged media therethrough.

2. Background Art

Primary surface heat exchangers have been developed which incorporate thin alloy metal sheets, such as stainless steel that have been corrugated or folded in the nature of pleating. Heat is transferred directly through the sheets which are suitably welded together around their peripheries to prevent the mixture of the fluid or gaseous media. The corrugations in the sheets serve to support adjacent sheets in a stacked array forming a heat exchanger assembly.

Before the sheets are stacked in the assembly, the edge portions of each sheet are crushed between dies to provide flattened header sections which will facilitate the counterflow of fluid. These header sections at each end of the individual sheets receive the media and deliver them to the appropriate passages on both sides of each sheet.

Stacked plate heat exchangers of the type described are illustrated by U.S. Pat. No. 3,291,206 to T. P. Nicholson on Dec. 13, 1966; U.S. Pat. No. 3,759,323 to H. J. Dawson et al on Sept 18, 1973; and U.S. Pat. No. 4,022,050 to B. J. Davis, et al on May 10, 1977. In fabricating such heat exchangers, difficulties have been encountered in flattening of the header sections. The header sections extend generally transversely to the corrugations, and as the corrugations are flattened by the dies they are invaribly subjected to an extensive flaring of each convolution in proximity to the crushed edges thereof. This flaring or expansion of each convolution partially blocks the cross sectional area of the fluid passages defined between adjacent sheets.

This general problem is more severe where the corrugations are deep and tend to form an exaggerated condition of multiple flattened or collapsed corrugations in the header sections. Consequently, use has been made of tailored die ramps in the crushing apparatus to provide outwardly tapered transition zones proximate the ends of the corrugations, hopefully to diminish the flow blockage problem. Such a solution is disclosed, for example, in U.S. Pat. No. 4,022,050 mentioned above, the disclosure of which is incorporated herein by reference. Because the shape of the flare is extremely difficult to control when the fin height is great, the solution of a gentle ramp is not as satisfactory as is desired.

Adding to the complexity of the flaring problem are such factors as the need to accommodate the crushing of the corrugations of sheets having an asymmetrical cross section, or to corrugations having a serpentine configuration longitudinally across the sheet. For example, in many applications it is desirable to have a plurality of convolutions with broad crests on one side of each sheet and a plurality of convolutions with thinner crests on the other side to provide a differential flow area ratio for the fluid media.

While U.S. Pat. No. 2,988,033 to W. H. Gapp on June 13, 1961 discloses a pair of adjacent heat exchanger sheets in FIG. 1 having what appears to be slightly longitudinally offset tapered transition zones that could be helpful in reducing fluid blockage problems, there is no reference to such problems or the advantages thereof in the body of the specification. Furthermore, the individual sheets of that patent have the transition zones transversely aligned so that the fluid media blockage reduction at the ends of the corrugations is not effectively minimized.

The present invention is directed to overcoming one or more of the problems as set forth above.

DISCLOSURE OF THE INVENTION

Basically, the present invention utilizes a concept which results in a substantial reduction in the amount or degree of blockage of the fluid media at the transition zones of the corrugated sheets.

In one aspect of the present invention a stacked plate heat exchanger is provided including a plurality of sheets having a centrally disposed corrugated portion and first and second flattened edge portions to facilitate flow of fluid media alternately between and generally longitudinally across the sheets. The corrugated portion of each sheet includes a plurality of convolutions individually having a transition zone intermediate the corrugated portion and each of the edge portions. And, advantageously, the transition zones are located at different longitudinal positions transversely across the sheets to define a plurality of staggered flow path ends in order to reduce fluid flow blockage thereat.

By staggering the fluid flow paths in the superimposed sheets a heat exchanger construction is provided wherein the transition blockage is minimized at the opposite ends of the convolutions and the fluid media can better pass around the blocked or flared portions of the individual convolutions.

The foregoing and other aspects will become apparent from the following detailed description of the invention when considered in conjunction with the accompanying drawings.

BEST MODE FOR CARRYING OUT THE INVENTION

Figure 1:
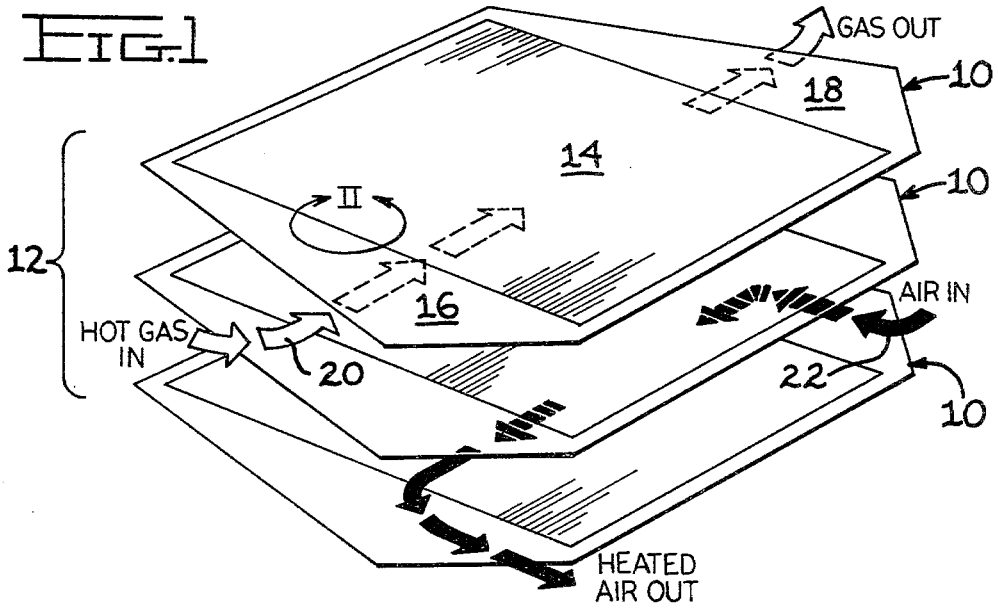
FIG. 1 is an exploded, perspective view of a group of three heat exchanger sheets which have been manufactured in accordance with the present invention.

Referring initially to FIG. 1, three corrugated heat exchanger sheets or plates 10 constructed in accordance with the present invention are shown which are preferably made from a thin metal material such as stainless steel. The sheets are arranged in a stack, as indicated generally at 12, and individually include a centrally disposed corrugated portion 14 and first and second flattened edge portions 16,18 to facilitate flow of first and second fluid media 20,22 alternately between and generally longitudinally across the sheets. In the instant example the corrugated portions provide a plurality of rectangular counterflow areas and the flattened edge portions provide pairs of outer triangularly shaped cross flow zones flanking the opposite ends of the counterflow areas. Moreover, the first medium is hot gas which is directed generally across the region between the first and second sheets, and the second medium is air to be heated which is directed generally longitudinally between the second and third sheets of the drawing as is illustrated. The zones 16,18 generally serve as manifolds to direct hot gas to the corrugated portion as well as away from it on the opposite end of the sheet and to direct heated air away from the corrugated portions as well as to direct cool air to the corrugated portion at the opposite end of the sheet. In this way gas and air, or other suitable fluids, are advantageously communicated in opposite directions alternately between the sheets of the heat exchanger in an effective counterflowing manner.

Figure 3:
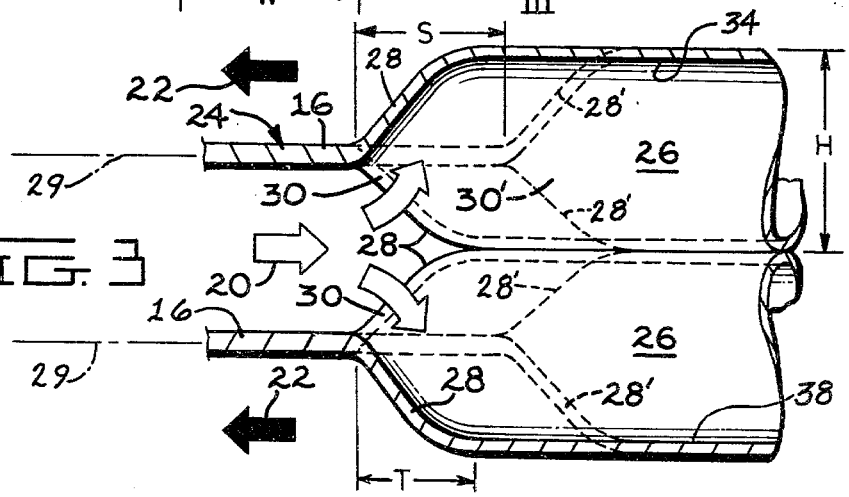
FIG. 3 is a diagrammatic, fragmentary, sectional view through a pair of adjacent corrugated sheets as taken along line III—III of FIG. 2.
Figure 4:
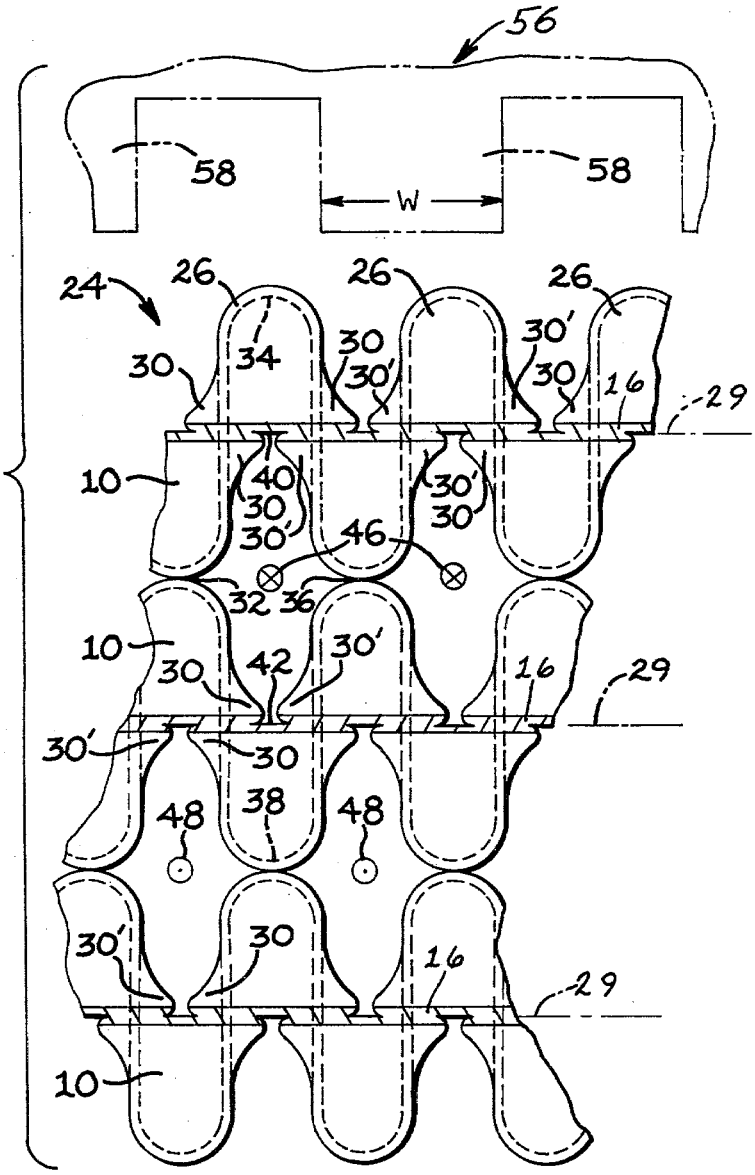
FIG. 4 is a diagrammatic, fragmentary, cross sectional view as taken along line IV—IV of FIG. 2, showing in phantom outline above the cross section a crenellated die useful for crushing the ends of the sheet convolutions in staggered relation.

As is shown in FIGS. 3 and 4, a compact heat exchanger assembly 24 includes a plurality of the sheets 10 which are alternately disposed in superimposed relation to form the vertically aligned stack 12. The corrugated portion 14 of each sheet includes a plurality of convolutions 26 having a height "H" and a transition zone 28 having a length "T" intermediate the corrugated portion and each of the edge portions 16,18 as is shown best in FIG. 3. The sheets are preferably not oriented the same way in the stack, but rather are beneficially arranged in crest-to-crest facing pairs so that the convolutions thereof are facing one another in a predetermined manner to optimize heat transfer, to prevent nesting, and to minimize fluid flow blockage at or near the transition zones 28.

Referring to FIG. 4, all of the vertically extended and repetitive transverse convolutions 26 define generally longitudinally oriented passages for the fluid flow between the opposite flattened edge portions 16,18. Each of the convolutions extends upwardly and depends downwardly a similar and relatively large distance from a central plane 29 thereof, and provides a greatly vertically extended uniform sheet height when compared with the relatively thin sheet thickness of from 2 to 8 mils. Because of this greatly vertically extended sheet height, a flare or bulge 30 occurs when the edge portions 16,18 are formed between the forming dies. As shown clearly in FIG. 4 the bulges 30 have a tendency to partially block the passage of the fluid media between the sheets 10. In order to substantially utilize the entire fluid flow path or cross sectional area designated as 32,34,36,38 in FIG. 4, for example, the gaseous fluid medium must squeeze through a section defined by 32,40,36,42. In FIG. 4 the gas flow arrow feathered ends are designated by the reference numeral 46 and the air flow arrow tips are designated by the numeral 48. Thus, the gas inflow arrow is shown between the upper and second sheet of FIG. 4 and the air outflow arrow is shown between the second and third sheets thereof. It is clear that the bulges 30 restrict flow of air at the entrance and exit of the convolutions as well as restricting the flow of gas at the entrance and exit thereof.

Figure 2:
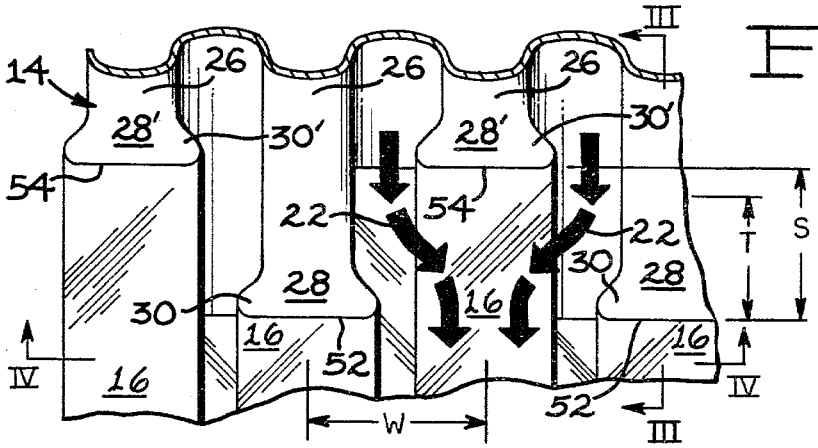
FIG. 2 is a greatly enlarged, diagrammatic, fragmentary plan view of the upper sheet illustrated in FIG. 1 as viewed in the region of arrows II—II thereof.

In accordance with the present invention, and as is clearly illustrated in FIGS. 2 and 3, the adjacent convergingly tapered transition zones 28,28' are located at different longitudinal positions in each of the individual corrugated sheets to define first and second pluralities of offset flow path ends 52,54. In the example illustrated the respective flow path ends at the distal end of the convolutions 26 are alternately staggered a preselected distance S as is indicated in the drawings. This can be achieved by selectively crushing the ends of the convolutions between a pair of crenellated or serrated dies 56, one of which is partly illustrated in phantom lines at the top of FIG. 4. I contemplate that the solid outwardly extending protruding portions or tapered merlon portions 58 of each die should be preferably substantially transversely aligned with each other, and that the crushing can be achieved between either planar dies or between a pair of roller type dies having a crenellated, and tapered ramp construction.

The advantages of this construction can be appreciated by reference to FIG. 4, wherein the bulges designated by the reference numeral 30 are near to the viewer in the same plane, and those bulges designated by the reference numeral 30' are further from the viewer in another plane offset by the stagger distance S. Note that the bulges 30,30' which appear adjacent to each other on the same side of the sheet 10 in the end view are actually longitudinally offset. This construction is true for the air flow path as well as the gas flow path. Thus, for the region bounded by the reference numerals 32,40,36,42 the amount of frontal area blockage is reduced by the staggered positions of the bulges 30'. Because the respective gas and air media can get around the bulges 30,30' by movement in a direction generally transverse to the central plane 29 of the sheets 10 blockage of these passages is reduced to a minimal value.

I also contemplate that the transition zones 28 or the bulges 30 can be longitudinally offset in a preselected repetitive pattern which varies transversely across the sheets 10 as a function greater than the wave length "W" of the convolutions 26. For example, rather than having alternate recessed bulges 30' as is shown in the drawings, alternate pairs of the bulges 30' may be crushed in staggered relation to adjacent pairs of bulges 30, or some other stepped or staggered relationship can be effected. Such staggering also applies to convolutions which are sinuously profiled in the general direction of fluid flow, rather than to the relatively straight convolutions illustrated.

INDUSTRIAL APPLICABILITY

The heat exchanger 24 finds particular utility in conjunction with a gas turbine engine. By staggering the flow path ends 52,54 of the fluid media 20,22 a reduction in the pressure drop across the heat exchanger can be achieved. Thus, the heat exchanger's overall effectiveness can be improved by selectively crushing the individual sheets 10 and having bulges 30,30' at the opposite ends of the convolutions 26 in the regions of the transition zones 28. In the instant example, every even numbered convolution has been crushed a first preselected longitudinal distance from the edge of the sheet, and every odd numbered convolution has been crushed a second preselected longitudinal distance from the edge of the sheet. However, other repetitive and tapered offset patterns are contemplated.

In assembling of the sheets 10, it is to be appreciated that it is only necessary to turn alternate ones of the sheets over to obtain the desired passage configurations longitudinally across and between the sheets in the stack 12. The convolutions 26 of each of the identical sheets can be formed with longitudinal waves to prevent nesting of the sheets and to increase the stiffness and strength of the individual sheets. Thus, the sheets 10 can be stacked in facing pairs in crest-to-crest bridging relation, and with the entry and exit bulges 30 positioned for minimal restriction.

Other aspects, objects and advantages of this invention can be obtained from a study of the drawings, the disclosure and the appended claims.

What is claimed is:

1. In a heat exchanger (24) including a plurality of sheets (10) arranged in a stack (12), each of said sheets (10) including a centrally disposed corrugated portion (14) and first and second flattened edge portions (16,18) to facilitate flow of first and second fluid media (20,22) alternately between and generally longitudinally across said sheets (10), each corrugated portion (14) including a plurality of convolutions (26) individually having a transition zone (28) intermediate said corrugated portion (14) and each of said edge portions (16,18), the improvement comprising:

locating said transition zones (28) at different longitudinal positions transversely across said sheet (10) to define a plurality of staggered flow path ends (52,54) of a construction sufficient for reducing flow blockage of the fluid media (20,22) thereat.

2. The heat exchanger (24) of claim 1 wherein said transition zones (28) of adjacent ones of said convolutions (26) are longitudinally offset a preselected distance S.

3. The heat exchanger (24) of claim 1 wherein said transition zones (28) are longitudinally offset in a preselected repetitive pattern varying as a function of the wave length W of said convolutions (26).

4. The heat exchanger (24) of claim 1 wherein said transition zones (28) are longitudinally offset in a preselected repetitive pattern varying as a function greater than the wave length W of said convolutions (26).

5. The heat exchanger (24) of claim 1 wherein each of said transition zones (28) gradually tapers in a converging manner toward said flattened edge portions (16,18).

* * * * *